US007383672B2

(12) United States Patent
Taylor et al.

(10) Patent No.: US 7,383,672 B2
(45) Date of Patent: Jun. 10, 2008

(54) PACKAGE ASSEMBLY AND MACHINE AND METHOD FOR MANUFACTURE THEREOF

(75) Inventors: Alfred Alexander Taylor, Lugarno (AU); Luigi Di Palma, Mexico (MX)

(73) Assignee: TNA Australia Pty Limited, Lidcombe, New South Wales (AU)

( * ) Notice: Subject to any disclaimer, the term of this patent is extended or adjusted under 35 U.S.C. 154(b) by 932 days.

(21) Appl. No.: 10/613,568

(22) Filed: Jul. 2, 2003

(65) Prior Publication Data

US 2004/0082452 A1 Apr. 29, 2004

(30) Foreign Application Priority Data

Jul. 2, 2002 (AU) ..... PS3337

(51) Int. Cl.
*B65B 61/00* (2006.01)

(52) U.S. Cl. ..... 53/134.1; 53/551; 53/591

(58) Field of Classification Search ..... 53/591
See application file for complete search history.

(56) References Cited

U.S. PATENT DOCUMENTS

| | | | | |
|---|---|---|---|---|
| 2,272,623 | A | 2/1942 | Runner | |
| 3,608,709 | A * | 9/1971 | Pike | 206/219 |
| 3,864,895 | A * | 2/1975 | Petrea | 156/556 |
| 4,493,178 | A * | 1/1985 | Buckner et al. | 53/131.5 |
| 5,335,479 | A * | 8/1994 | Lemke et al. | 53/426 |
| 5,433,060 | A * | 7/1995 | Gur et al. | 53/413 |
| 6,230,474 | B1 * | 5/2001 | Giacoman | 53/450 |
| 6,481,184 | B1 * | 11/2002 | Junker et al. | 53/413 |
| 6,560,948 | B1 * | 5/2003 | Fuss et al. | 53/459 |
| 6,726,794 | B2 * | 4/2004 | Belt | 156/265 |
| 6,962,035 | B2 * | 11/2005 | Yamamoto et al. | 53/135.1 |
| 7,003,926 | B2 * | 2/2006 | Yamamoto et al. | 53/136.1 |
| 7,093,404 | B2 * | 8/2006 | Kubo et al. | 53/136.1 |

FOREIGN PATENT DOCUMENTS

| | | |
|---|---|---|
| DE | 199 41 431 A1 | 3/2001 |
| WO | WO 98/52823 A | 11/1998 |
| WO | WO 98/52823 A1 | 11/1998 |
| WO | WO 00/73149 A | 7/2000 |

* cited by examiner

*Primary Examiner*—John Sipos
(74) *Attorney, Agent, or Firm*—Townsend and Townsend and Crew, LLP

(57) ABSTRACT

A package assembly (10) that includes a strip (11) of flexible plastic material. Attached to the strip (11) at spaced positions longitudinally of the strip (11) are bags (12). The bags (12) are sealingly closed and include end sealed areas (13 and 14). Each bag (12) is attached to the strip (11) by a respective one of the end sealed areas (13). Each end sealed area (13) can be peeled from the strip (11) to enable removal of the bag (12). In an alternative embodiment, the bags (12) are arranged in sets (17). A machine (28) is adapted to form the package assembly (10).

10 Claims, 6 Drawing Sheets

PACKAGE ASSEMBLY AND MACHINE AND METHOD FOR MANUFACTURE THEREOF

TECHNICAL FIELD

The present invention relates to package assemblies and to the methods and apparatus for producing package assemblies that include a carrier strip to which there is attached a plurality of packages. Typically, the packages would contain a snack food, with the assembly being adapted to be displayed at the point of sale.

BACKGROUND OF THE INVENTION

Disclosed in U.S. Pat. No. 5,433,060 is a flexible package assembly including a carrier strip to which there is attached a plurality of bags (typically containing a snack food). A purchaser of a bag removes the bag from the carrier strip.

In the above-mentioned US patent a machine is disclosed that produces packages (bags) that are removably attached to a carrier strip. In particular, the machine includes cooperating sealing jaws that not only close the bag but also attach the bag to the carrier strip. A purchaser of a bag removes the bag from the carrier strip. The sealing jaws include a slot through which the carrier strip passes so that when the sealing jaws engage the package to sealingly close the package, the sealed area of the bag is attached to the carrier strip. This sealed area provides a pealable attachment so that when a bag is to be removed the sealed area peels, allowing removal of the bag. Each bag is individually attached to the strip.

The above-described method and apparatus suffers from the disadvantage that only a single type of packaging assembly can be produced.

SUMMARY OF THE INVENTION

It is an object of the present invention to overcome or substantially ameliorate the above disadvantage.

There is disclosed herein a machine to produce a package assembly including a flexible strip to which there is attached a plurality of closed bags having end seal areas, the bags being delivered to the machine in an attached configuration connected at the end seal areas, the machine including:

a jaw assembly including a pair of movable opposing jaws that are caused to move to engage the strip and bags located therebetween to secure the bags to the strip at a one of the end seal areas;

a strip delivery mechanism to deliver the strip to the jaws;

a drive assembly to cause movement of the jaws; and wherein the jaw assembly includes a blade to cut the bags to separate the bags into sets, with each set being attached to the strip by a respective one of the end seal areas.

In one preferred form, the blade is movably mounted in one of the jaws to sever the set from further bags being delivered to the machine, the blade being movable between an extended position to engage the bags, and a retracted position at which the bags are not severed.

Each set will include at least one bag.

Preferably, the machine further includes an actuator assembly to cause movement of the blade.

Preferably, the actuator assembly includes a rotatably driven crank mechanism that causes linear reciprocation of the jaws.

Preferably, the delivery mechanism includes a slot in one of the jaws through which the strip passes.

Preferably, the above-mentioned machine is used in combination with a packaging machine that produces the bags, and wherein the packaging machine includes sealing jaws that engage the bags to form the end seal areas. In a further preferred form, the sealing jaws include a member to perforate each bag so that individual bags may be separated from their respective sets.

There is further disclosed herein a method of forming a packaging assembly, the method including the steps of:

providing a flexible strip;

providing a plurality of sealingly closed bags, the bags being joined by end seal areas;

cutting the bags into sets and attaching each set to the strip by a respective one of the end sealed areas.

Each set includes at least one bag.

In one preferred form, the above method includes perforating the bags so that each bag can be separated from the strip and adjacent bags.

There is still further disclosed herein a package assembly including a flexible strip and a plurality of bags attached to the strip at longitudinally spaced locations along the strip, with the bags being arranged in sets, each set including a plurality of bags with each bag having end seal areas; and wherein the bags of each set are attached to the strip by a respective one of the end seal areas.

In one preferred form, adjacent bags are attached by the end seal areas with a transverse weakened portion that is fractured to enable separation of the bags.

In one preferred form, each set is attached to the strip by an end seal area, at least some of the bags being attached by a weakened portion enabling separation of the bags.

Preferably, the end bag is adapted to peel off from the strip.

There is further disclosed herein a packaging assembly including:

a flexible strip; and a plurality of bags attached to the strip at longitudinally spaced locations along the strip, each bag being attached to the strip by an end seal area including a weakened portion that is fractured enabling separation of the bag from the strip.

BRIEF DESCRIPTION OF THE DRAWINGS

Preferred forms of the present invention will now be described by way of example with reference to the accompanying drawings wherein.

DETAILED DESCRIPTION OF THE PREFERRED EMBODIMENTS

Figure 1:
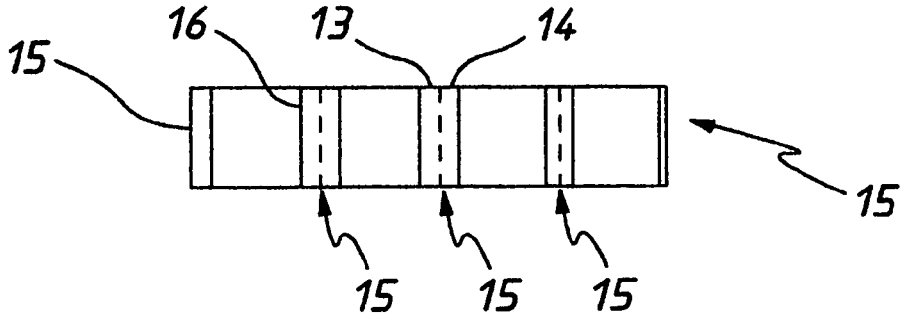
FIG. 1 is a schematic front elevation of a series of bags.

In the accompanying drawings, there is schematically depicted a package assembly 10. The assembly 10 includes a strip 11 of flexible material such as plastic. Attached to the strip 11 at spaced positions longitudinally along the strip 11 are bags 12. The bags 12 are sealingly closed and include end seal areas 13 and 14. In this embodiment, each bag 12 is attached to the strip 11 by an end seal area 13. Each end seal area 13 can be peeled from the strip 11 to enable removal of the bag 12.

Figure 3:
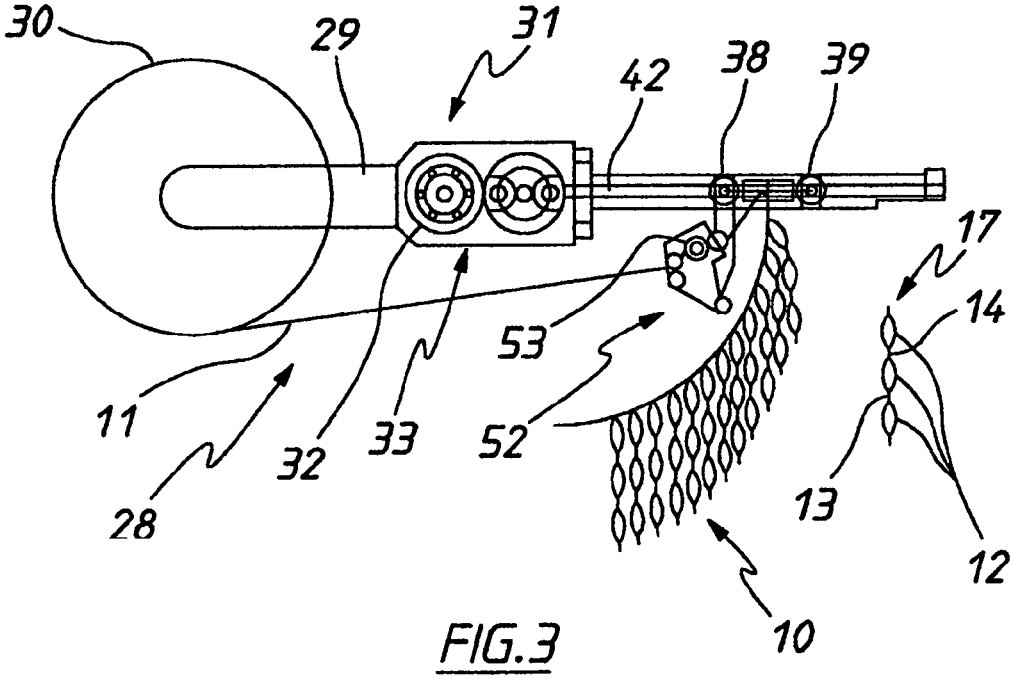
FIG. 3 is a further schematic side elevation of the machine of FIG. 2.

In FIG. 3, the bags 12 are arranged in sets 17. In this embodiment, each set includes three bags 12; however, it should be appreciated that each set may consist of any number of bags, that is, one or more bags 12.

Each set 17, as shown in FIG. 1, includes a plurality of bags 12, with adjacent bags 12 being connected by adjacent end seal areas 13 and 14. A transverse line of weakness 15 exists between each pair of adjacent bags 12. The transverse line of weakness 15 fractures to enable separation of the bag 12 from the strip 11. In this embodiment, the transverse line 15 of weakness is a line of perforations. In this respect, it should be appreciated that the end seal areas 13 and 14 include a sealed portion 16 that maintains each bag 12 sealingly closed despite the perforations forming the line 15 and separation of the bags 12 from the strip 11 upon fracturing of the line 15.

Figure 2:
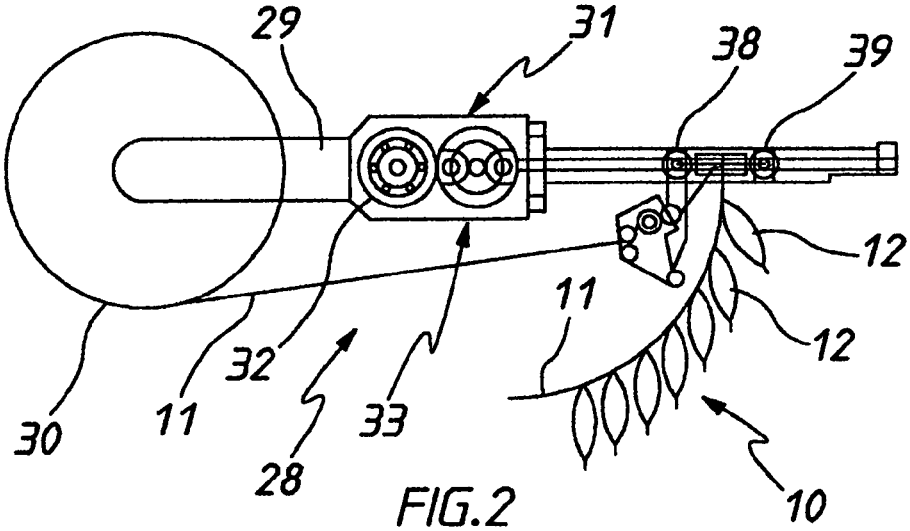
FIG. 2 is a schematic side elevation of a machine to produce a packaging assembly.
Figure 7:
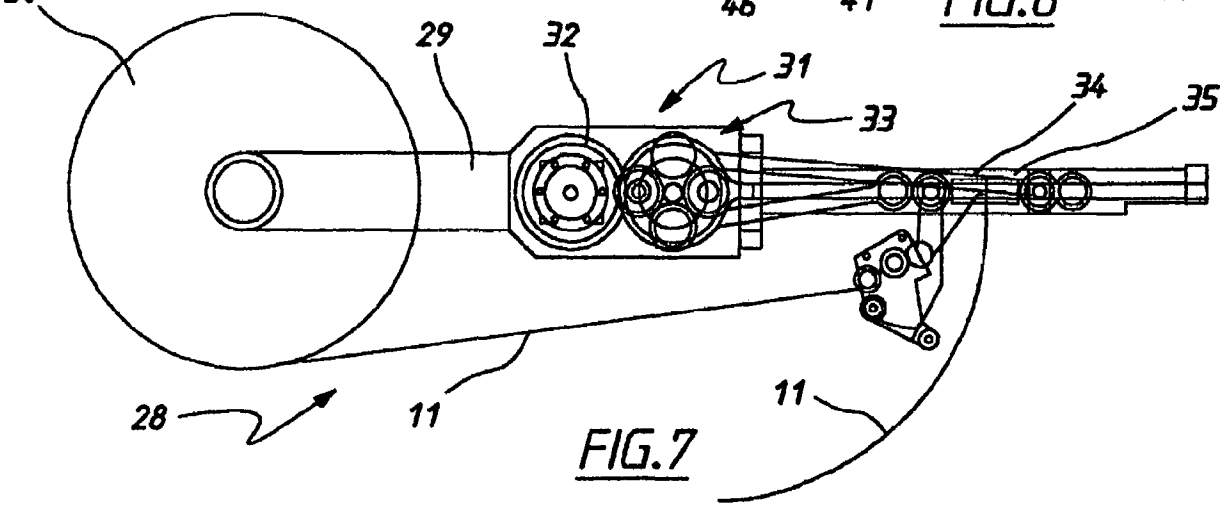
FIG. 7 is a schematic side elevation of the machine as shown in FIG. 6.
Figure 8:
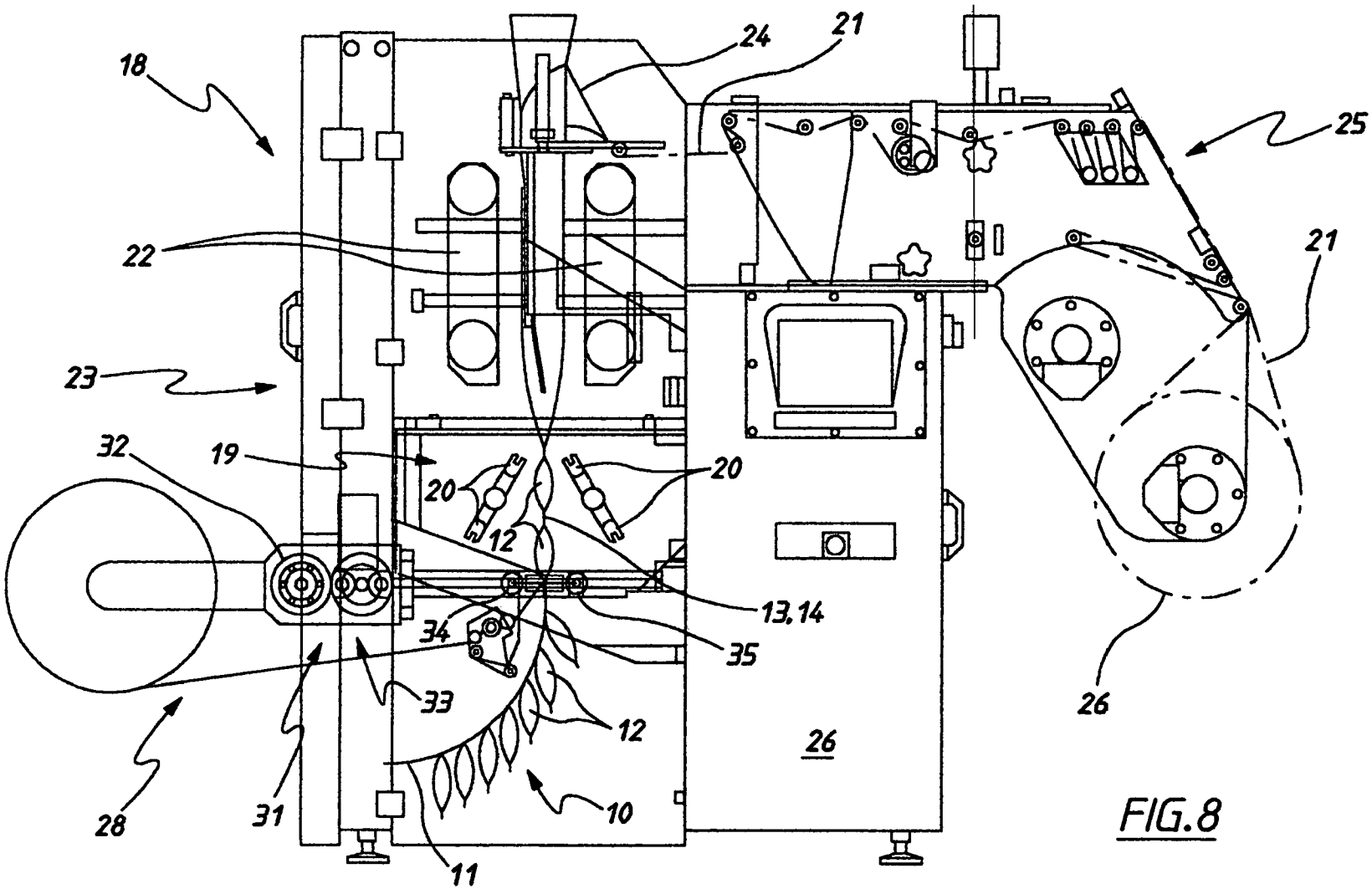
FIG. 8 is a schematic side elevation of a packaging machine and the machine of FIGS. 1 and 2.
Figure 9:
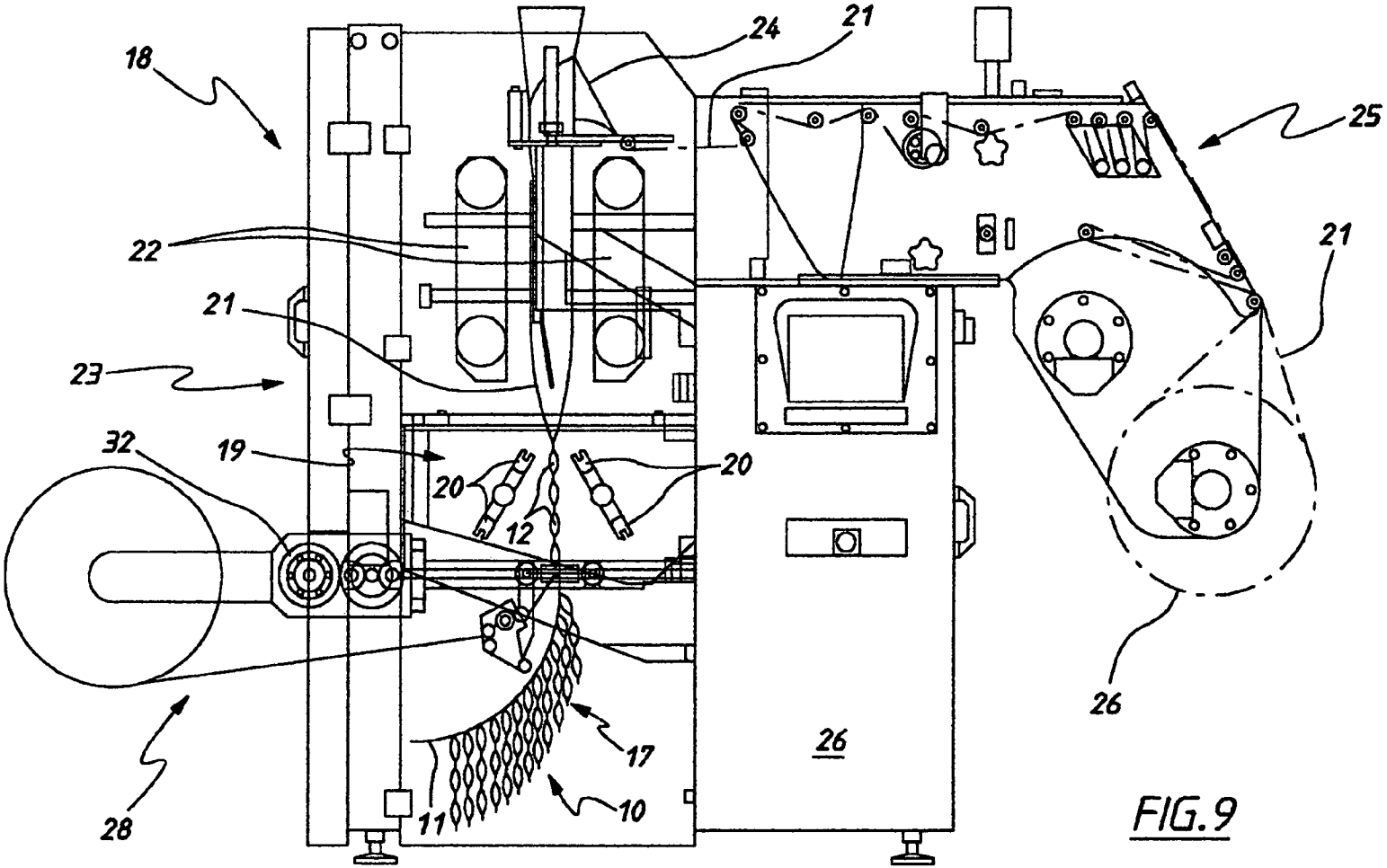
FIG. 9 is a further schematic side elevation of the packaging machine of FIG. 8 with the machine of FIG. 3.

Typically, the bags 12 would be formed by a packaging machine 18. The packaging machine 18 may be a packaging machine as described in U.S. Pat. No. 4,663,917. The packaging machine 18 includes rotatably driven jaws 19 having sealing heads 20. The sealing heads 20 engage tubular bag material 21 to form the transverse seal areas 13 and 14 and therefore the bags 12. However, with respect to the embodiment of FIGS. 2 and 4, it should be appreciated that the machine 18 does not include a knife in the jaws 20 that would normally engage the tubular bag material 20 to separate the bags 12. With respect to the embodiment of FIGS. 3 and 7, the knife is replaced with a perforating member 27 that forms the transverse line of weakness 15, that is, the perforations forming the line 15. The tubular bag material 20 is moved through the packaging machine 18 by means of a film drive unit 23 such as that described in U.S. Pat. No. 4,913,942. The unit 23 includes driven belts 22 that engage the tubular bag material 21 to cause movement thereof past the former 24 that receives the bag material 23 in strip form and forms it into a tubular configuration. The bag material 21 is delivered to the former 24 by means of a strip delivery assembly 25 that receives a roll 26 of bag material 21. The assembly 25 is of a known construction.

Associated with the machine 18 is a control panel 26 including electronic apparatus to govern operation of the machine 18.

Associated with the packaging machine 18 is a further machine 28 that receives a stream of connected bags 12 from the machine 18 and forms the package assemblies 10.

Figure 4:
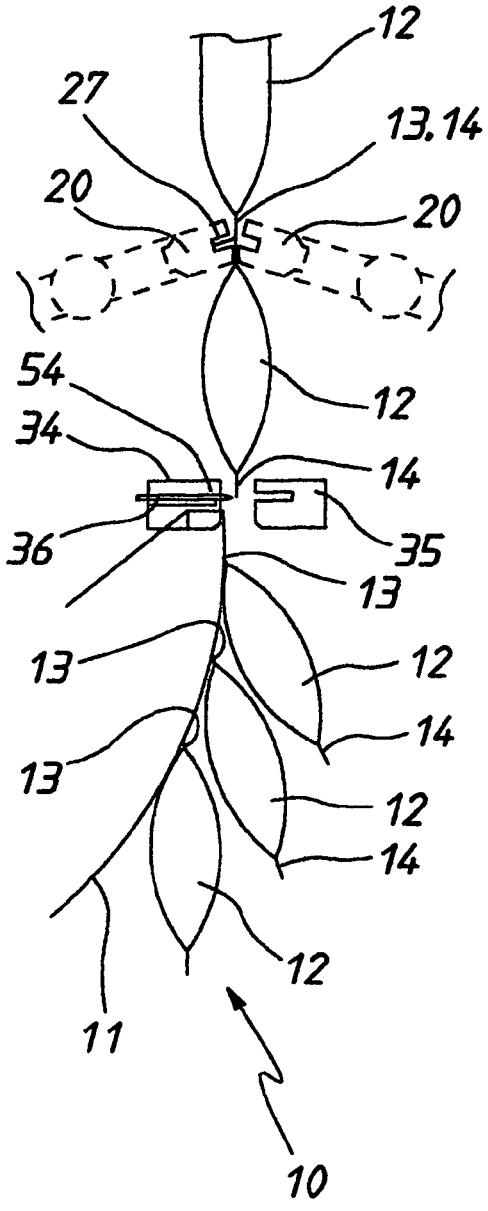
FIG. 4 is a schematic side elevation of the sealing jaws that produce sealingly closed bags, and jaws employed in the machine of FIG. 1.
Figure 5:
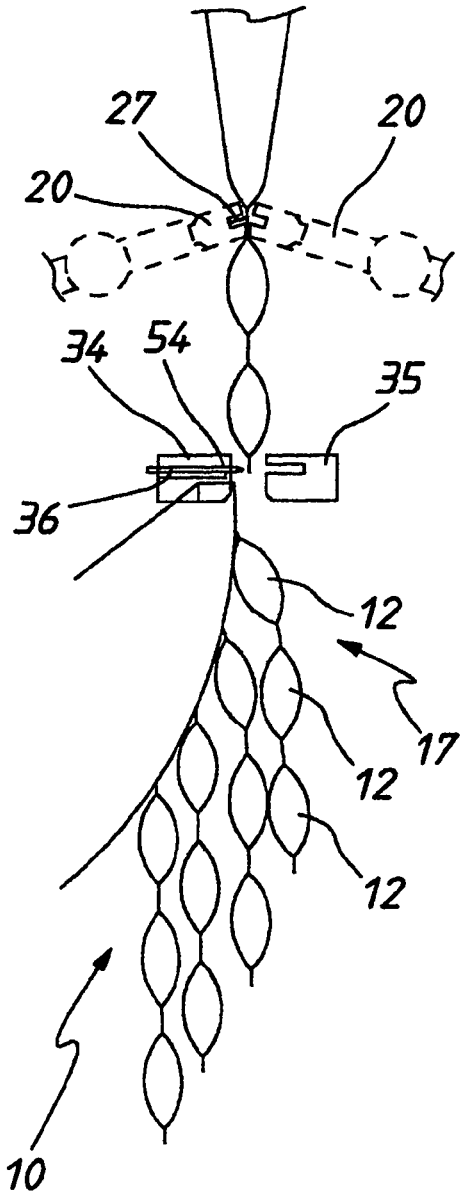
FIG. 5 is a further schematic side elevation of a modification of the packaging assembly of FIG. 3.
Figure 6:
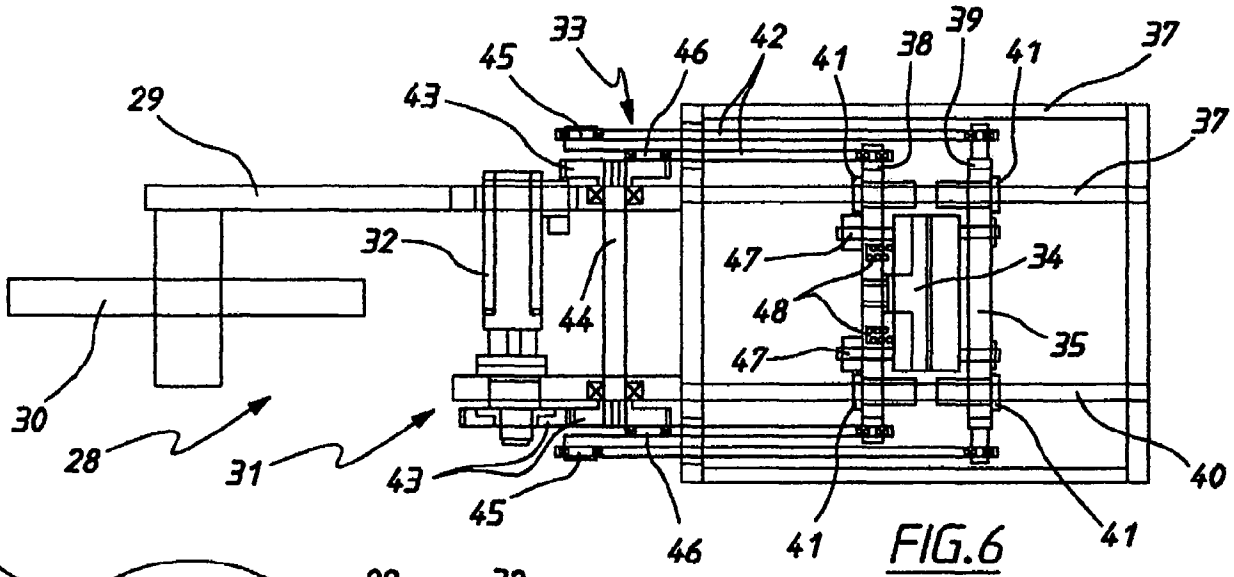
FIG. 6 is a schematic top plan view of the machine of FIGS. 2 and 3.

The machine 28 includes a base 29 that supports a roll 30 from which there is dispensed the flexible strip 11. Mounted on the base 29 is a drive assembly 31 including a motor 32 that drives crank mechanism 33. The crank mechanism 33 reciprocally drives a pair of jaws 34 and 35 that perform a number of functions. First of all, the jaws 34 and 35 are heated so that when they engage the end sealed areas 14 and 15 between adjacent bags 12, the bags 12 are attached thereby to the strip 11. In addition to this, the jaws 34 and 35 separate either individual bags 12 so as to provide the package assembly 10 of FIG. 2 or alternatively sever sets 17 from the bags 12 being delivered to the machine 28 so as to provide the bag assembly 10. More particularly, the jaw 34 includes a knife blade 36 that is movable between an extended position (as illustrated in FIGS. 4 and 5) to engage the end seal areas 13 and 14, and a retracted position so as to not separate adjacent bags 12.

In a first preferred form, the base 29 includes a frame 37 that movably supports carriages 38 and 39 which in turn support the jaws 34 and 35 respectively. More particularly, the carriages 38 and 39 are slidably mounted on bars 40, and are driven by the crank mechanism 33 to cause linear reciprocation of the jaws 34 and 35. The carriages 38 and 39 include slide bearings 41 that slidably engage the bars 40.

Extending from the crank mechanism 33 are drive rods 42 that are attached to the carriages 38 and 39.

The crank mechanism 33 includes gears 43 that rotatably drive the shaft 44. Attached to the shaft 44 are the gears 43 with projections 45 and 46. The projections 45 and 46 are 180 degrees out of phase and are connected to rods 42 to cause reciprocation of the carriages 38 and 39. More particularly, the projections 45 and 46 are spaced radially from the longitudinal axis of the shaft 44 so that upon being rotated about the longitudinal axis of the shaft 44 the rods 42 are caused to reciprocate. Bearings mount the rods 42 on the projections 45 and 46. Motion is transferred from the motor 32 to the shaft 44 via meshing engagement of the gears 43.

In a first embodiment the knife blade 36 is fixed to the carriage 38 and the jaw 34 slidably mounted via shafts 47. Springs 48 urge the jaw 34 to a position substantially covering the blade 36. However, upon the jaws 34 and 35 engaging, the jaw 34 retracts exposing the blade 36 which then cuts the end sealed areas 13 and 14 to provide separate bags 12 to be attached to the strip 11. In this embodiment, the assembly 10 has individual bags attached to the strip 11.

In a further embodiment the jaw 34 would be resiliently mounted by means of shafts 47 and springs 49 but the blade 36 is moved by means of an electric or pneumatic actuator 50. The actuator 50 would be electronically controlled so that the blade 36 is moved to an extended (cutting) position when required. For example, the actuator 50 could be operated so that the blade 36 cuts end seal areas 13 and 14 only after a series of bags 12 has passed the jaws 34 and 35. In this manner, the sets 17 may be formed.

Figure 10:
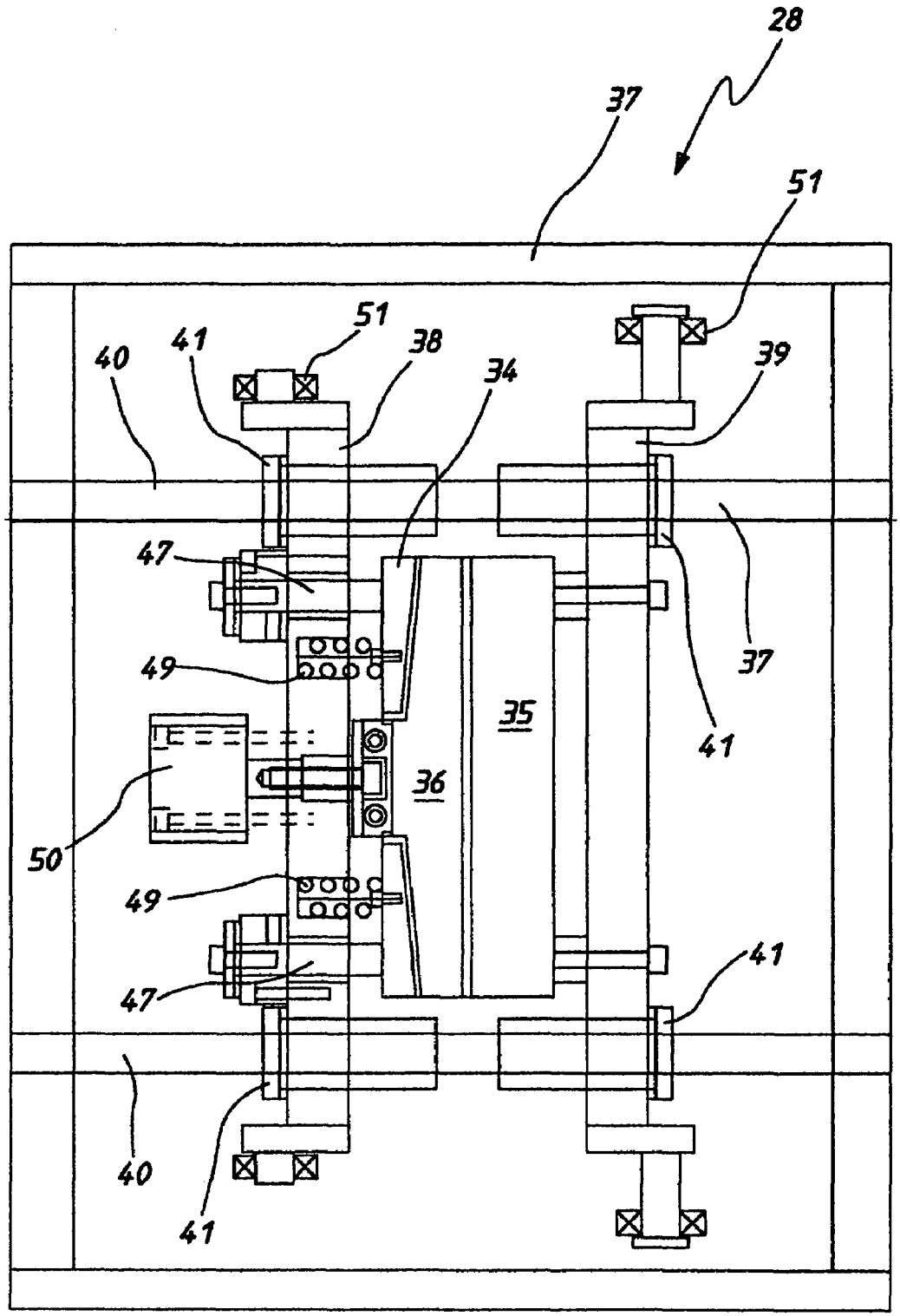
FIG. 10 is a further schematic plan view of portions of the machine of FIGS. 2 and 3.

As can be noted from FIG. 10, each carriage 38 and 39 is provided with a bearing 51 to which the associated rod 42 is supported on.

The machine 28 includes a film delivery unit 52 that includes a motor 53. The motor 53 is intermittently operated to deliver a required length of strip 11 to the jaw 34. As can be seen, the jaw 34 has a slot 54 through which the strip 11 passes. The strip 11 is pulled through the slot 54 due to the weight of the assemblies 10. An operator would cut the assemblies 10 to desired lengths.

The invention claimed is:

1. In combination an assembling machine and a packaging machine, said assembling machine being adapted to produce a package assembly including a flexible strip to which there is attached a plurality of closed bags, the bags being produced by said packaging machine so as to have end seal areas, with the bags being delivered to the assembling machine in an attached configuration connected at the end seal areas, said assembling machine including:

a jaw assembly including a pair of movable opposing jaws that are caused to move to engage the strip and bags located therebetween to secure the bags to the strip at a one of the end seal areas:

a strip delivery mechanism to deliver the strip to the jaws;

a drive assembly to cause movement of the jaws; and wherein said jaw assembly includes a blade adapted to cut the bags and separate the bags into sets of a plurality of bags and attaching each set to the strip by a respective one of the end seal areas with said blade being movable relative to the jaws to cut a desired number of bags for each set that is to be attached to the strip.

2. The combination of claim 1 wherein, said blade is movably mounted in one of the jaws to sever the set from further bags being delivered to the machine, said blade being movable between an extended position to engage the bags, and a retracted position at which the bags are not severed.

3. The combination of claim 1 further including an actuation assembly for moving the blade relative to the jaws.

4. The combination of claim 3 further including an actuator including a rotatably driven crank mechanism for linearly reciprocating the jaws.

5. The combination of claim 1 wherein, the delivery mechanism includes a slot in one of the jaws through which the strip passes.

6. The combination of claim 1, wherein said sealing jaws include a member to perforate the end seal areas between adjacent bags so that individual bags may be separated from their respective sets.

7. The combination of claim 2 further including an actuator for moving the blade relative to the jaws to thereby enable selection of the number of bags in each set of bags.

8. The combination of claim 7 further wherein the actuator includes a rotatably driven crank mechanism for linearly reciprocating the jaws.

9. The combination of claim 8 wherein, the delivery mechanism includes a slot in one of the jaws through which the strip passes.

10. The combination of claim 9, wherein said sealing jaws include a member to perforate the end seal areas between adjacent bags so that individual bags may be separated from their respective sets.

* * * * *